US006973980B2

(12) United States Patent
Stepenoff et al.

(10) Patent No.: US 6,973,980 B2
(45) Date of Patent: Dec. 13, 2005

(54) PETROLEUM DRILLING METHOD AND APPARATUS TO COOL AND CLEAN DRILL BIT WITH RECIRCULATING FLUID COMPOSITION WHILE RECLAIMING MOST WATER UTILIZED AND GREATLY REDUCING THE NORMAL CONSUMPTION OF WATER DURING DRILLING

(76) Inventors: G. Scott Stepenoff, 10291 E. Caribbean La., Scottsdale, AZ (US) 85259; Gary F. Stepenoff, 10291 E. Caribbean La., Scottsdale, AZ (US) 85259

( * ) Notice: Subject to any disclaimer, the term of this patent is extended or adjusted under 35 U.S.C. 154(b) by 44 days.

(21) Appl. No.: 10/628,025

(22) Filed: Jul. 25, 2003

(65) Prior Publication Data

US 2005/0016773 A1 Jan. 27, 2005

(51) Int. Cl.[7] ..... E21B 21/06
(52) U.S. Cl. ..... 175/206; 175/66; 210/512.3
(58) Field of Search ..... 175/66, 206, 207; 210/512.3; 494/50, 60

(56) References Cited

U.S. PATENT DOCUMENTS 5,284,250 A 2/1994 Stepenhoff
2003/0217866 A1 * 11/2003 deBoer ..... 175/66

* cited by examiner

*Primary Examiner*—David Bagnell
*Assistant Examiner*—Giovanna M Collins
(74) *Attorney, Agent, or Firm*—Tod R. Nissle, P.C.

(57) ABSTRACT

A method and apparatus are provided for drilling for petroleum. The method and apparatus circulate drilling mud through a particle separation apparatus that rapidly removes clay and other chemical additives. The drilling method and apparatus of the invention drastically reduces the amount of water required to drill a petroleum well, processes drilling mud at the well site, and produces water that can be broadcast on ground adjacent the well site, that can be introduced into deep water injection wells, or that can be given to livestock.

14 Claims, 4 Drawing Sheets

PETROLEUM DRILLING METHOD AND APPARATUS TO COOL AND CLEAN DRILL BIT WITH RECIRCULATING FLUID COMPOSITION WHILE RECLAIMING MOST WATER UTILIZED AND GREATLY REDUCING THE NORMAL CONSUMPTION OF WATER DURING DRILLING

This invention pertains to methods and apparatus for drilling for petroleum.

More particularly, the invention pertains to a petroleum drilling method and apparatus that utilizes a hollow drill pipe and utilizes a drill bit at the lower end of the drill pipe to bore a hole in the ground.

In a further respect, the invention pertains to a petroleum drilling method and apparatus that circulates an aqueous fluid composition, or "drilling mud", downwardly through the drill pipe and back up through the hole bored by the drill bit.

In another respect, the invention pertains to a petroleum drilling method and apparatus of the type described that greatly reduces the quantity of water typically utilized during the drilling of a petroleum well.

In still another respect, the invention pertains to a petroleum drilling method that, in contrast to conventional drilling methods, processes drilling mud to produce water that typically can be safely broadcast adjacent the well, can be used to water livestock, or can be stored in deep water injection wells.

When a petroleum well is drilled, about 80,000 to 250,000 gallons of water are consumed. This large water consumption creates significant problems. For example, when petroleum wells are drilled in certain areas in the province of Alberta, Canada, there is little available water. Consequently, water must be trucked in, often over distances of hundreds of miles. Trucking water is costly. More importantly, once water is incorporated as a component of drilling mud, the water is contaminated either with clay and/or with other additives that are used to facilitate the drilling process. A variety chemicals are used as additives in drilling mud. Such additives can include, by way of example and not limitation, floculants, surfactants, diesel fuel (inverted drilling muds), and kerosene (inverted drilling muds).

There appears presently to be no satisfactory process for economically and quickly cleaning water that has been incorporated in a drilling mud. It is advantageous to clean the water because it is difficult to dispose of drilling mud. The additives in drilling mud often are toxic and ordinarily make the drilling mud unsuitable to broadcast on the land adjacent the petroleum well.

One solution to the problem of disposing of drilling mud is to truck the drilling mud to a disposal site. Such disposal sites often are hundreds of miles away and the cost of trucking the drilling mud is substantial. And, there is never any guarantee that thousands of gallons of drilling mud deposited of at such disposal sites will not eventually contaminate the ground water. This solution is not environmentally friendly.

Another solution to the problem of disposing of drilling is to place drilling mud in large holding tanks that permit particulate in the drilling mud to settle out to produce water having fewer contaminants. One disadvantage of this solution is the cost of erecting and manning large settling ponds or tanks. Another disadvantage of this solution is that it may take years for clay and sands to settle out of the water. A further disadvantage of this solution is that some submicron materials never settle out and that such submicron materials prevent the water from being disposed of in deep water injection wells because the materials block or clog the wells. Still another disadvantage of the this solution is that some other toxic chemicals may not settle out of the water. This solution also is not particularly environmentally friendly.

In sum, current solutions for treating or disposing of toxic drilling mud appear too costly, are too time consuming, can not be utilized at the drilling site, and are not environmentally friendly.

The problem of disposing of drilling mud has long been a serious problem and is becoming more so because of water shortages and because of a general emphasis on minimizing environmental pollution and on minimizing cancer, other diseases, and other negative influences directly associated with environmental pollution.

Accordingly, it would be highly desirable to provide an improved method and apparatus for processing drilling mud used and produced during the drilling of petroleum wells.

Therefore, it is a principal object of the invention to provide an improved method and apparatus for drilling for petroleum.

A further object of the invention is to provide an improved method and apparatus that greatly reduces the volume of water consumed during the drilling of a petroleum well.

Another object of the invention is to provide an improved petroleum drilling method and apparatus that quickly and inexpensively processes drilling mud.

Still a further object of the invention is to provide an improved petroleum drilling method and apparatus that produces a water by-product having a purity sufficient to permit the water to be disposed of in a deep water injection well, to be disposed of by broadcasting the water on the ground adjacent the drilling site, to be utilized as livestock drinking water, or to be reused during the drilling process.

These and other, further and more specific objects and advantages of the invention will be apparent from the following detailed description of the invention, taken in conjunction with the drawings, in which.

Figure 1:
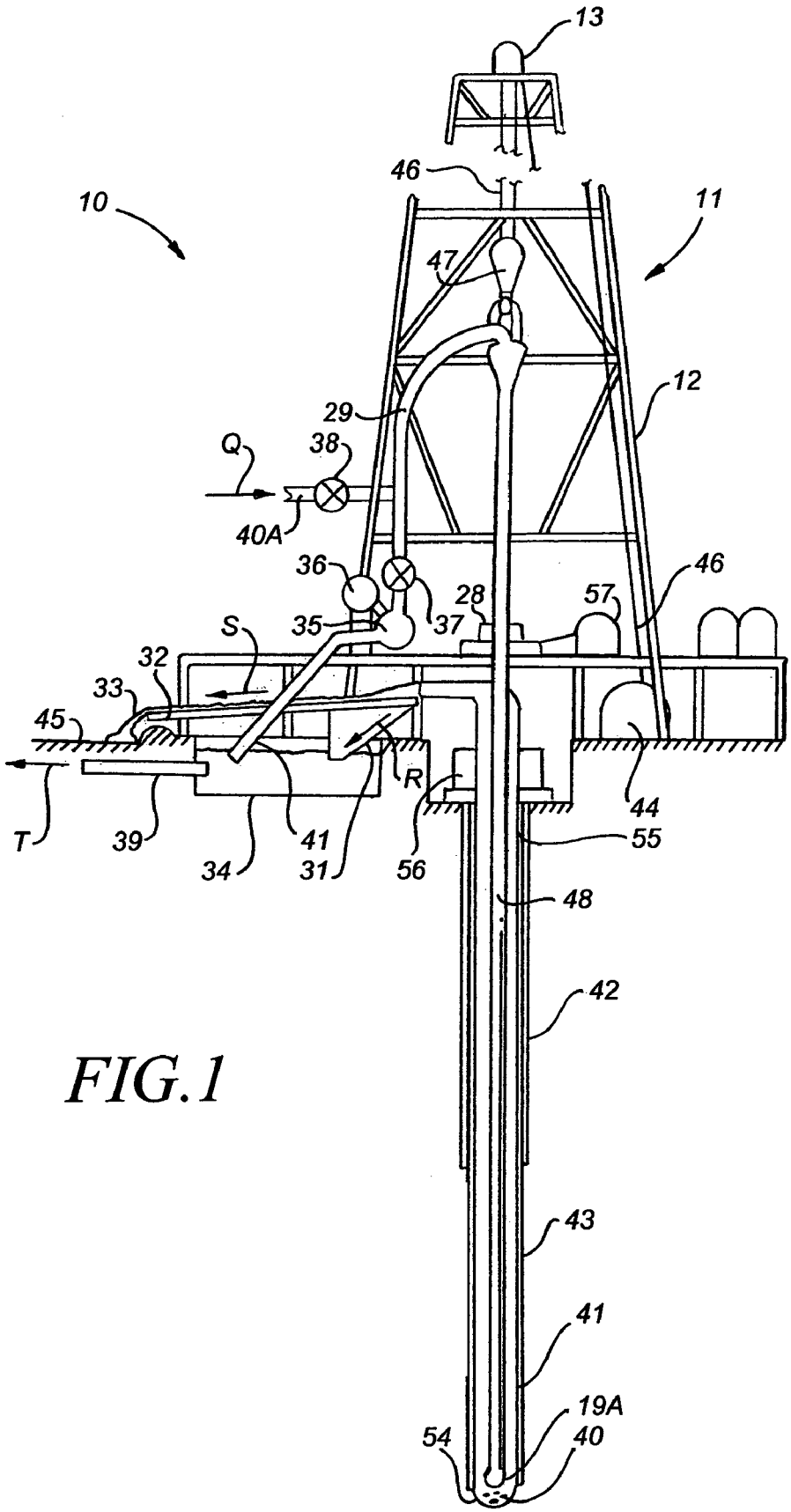
FIG. 1 is an elevation partial-section view illustrating a petroleum drilling system constructed in accordance with the principles of the invention.

Briefly, in accordance with my invention, I provide an improved method for drilling for petroleum. The improved method includes the steps of erecting a derrick assembly on the ground; mounting a drill on the derrick assembly, the drill including a hollow drill pipe having an upper end and a lower end and a drill bit attached to the lower end; mounting a rotary assembly at the derrick assembly to provide motive power to rotate the drill bit; mounting a drilling mud circulation system at the derrick assembly to direct drilling mud into the upper end of the drill pipe, down through the drill pipe, out the lower end of the drill pipe, and up through a hole in the ground to produce auxiliary drilling mud containing drill bit cuttings; providing a source of drilling mud for the circulation system, the mud comprising water and at least one additive selected from the group consisting clay and auxiliary chemical additives to facilitate drilling; and, erecting a first particle separation apparatus. The particle separation apparatus includes a wall defining a separation chamber; a feed orifice formed in the chamber; a rotary distributor in the chamber provided with a rotating distribution disk system including an upper surface; a system for rotatably driving the rotary distributor; an outlet formed in the wall; an open toroidal-shaped particle circulation space intermediate the disk system and the outlet and circumscribed by a portion of the wall, the outlet opening into the toroidal-shaped space; and, a charging system. The charging system is operatively associated with the drilling mud circulation system for charging auxiliary drilling mud through the orifice into the separation chamber toward the rotary distributor such that the auxiliary drilling mud, at least in part, impinges the upper surface. The rotary distributor provides the motive power to move at least a portion of the auxiliary drilling mud outwardly over the upper surface and into the chamber away from the rotary distributor, to move a first portion of the auxiliary drilling mud over the upper surface and into the chamber in a primary continuous helical path of travel away from the rotary distributor and the orifice through the toroidal-shaped space toward and into the outlet; and, to move a second portion of the auxiliary drilling mud in a secondary recirculating helical path of travel away from the rotary distributor and the orifice through the toroidal-shaped space toward the outlet and away from the outlet back toward the rotary distributor. The method also includes the steps of rotating the drill into the ground with the rotary assembly to form the hole in the ground and produce drill bit cuttings in the hole, the hole having a top and a side; circulating drilling mud with the mud circulation system along a path down into the upper end of the drill pipe, through the drill pipe, out the lower end of the drill pipe, up through the hole intermediate the drill pipe and the side of the hole, and out through the top of the hole to produce auxiliary drilling mud; and, transporting the auxiliary drilling mud to the charging system. The charging system directs the auxiliary mud through the orifice into the separation chamber toward the rotary distributor such that the auxiliary drilling mud, at least in part, impinges the upper surface.

Figure 3:
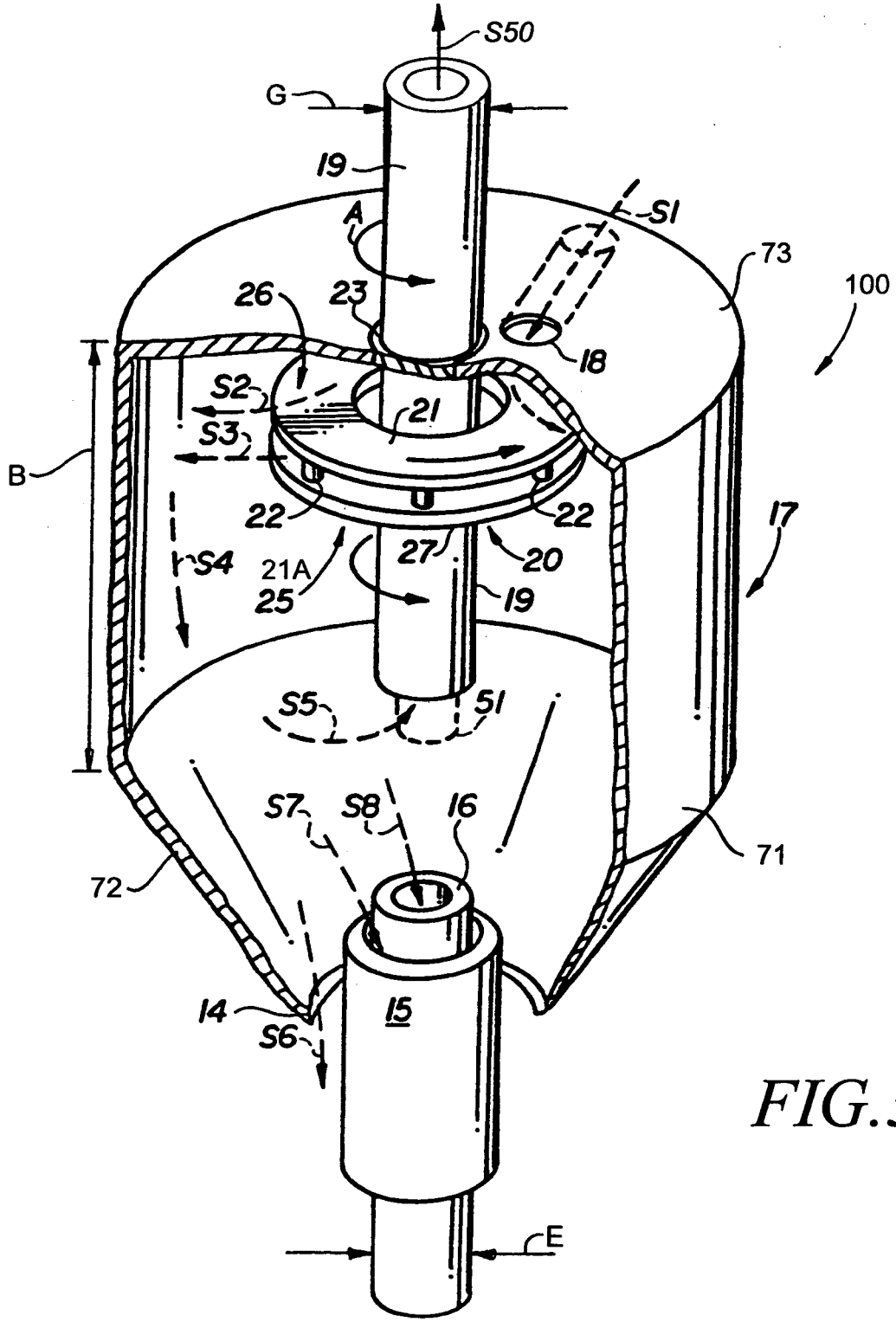
FIG. 3 is a perspective partial section view of a particle separation apparatus used in the petroleum drilling system of the invention; and, FIG. 4 is a front elevation partial section view of a preferred particle separation apparatus used in the petroleum drilling system of the invention.
Figure 4:
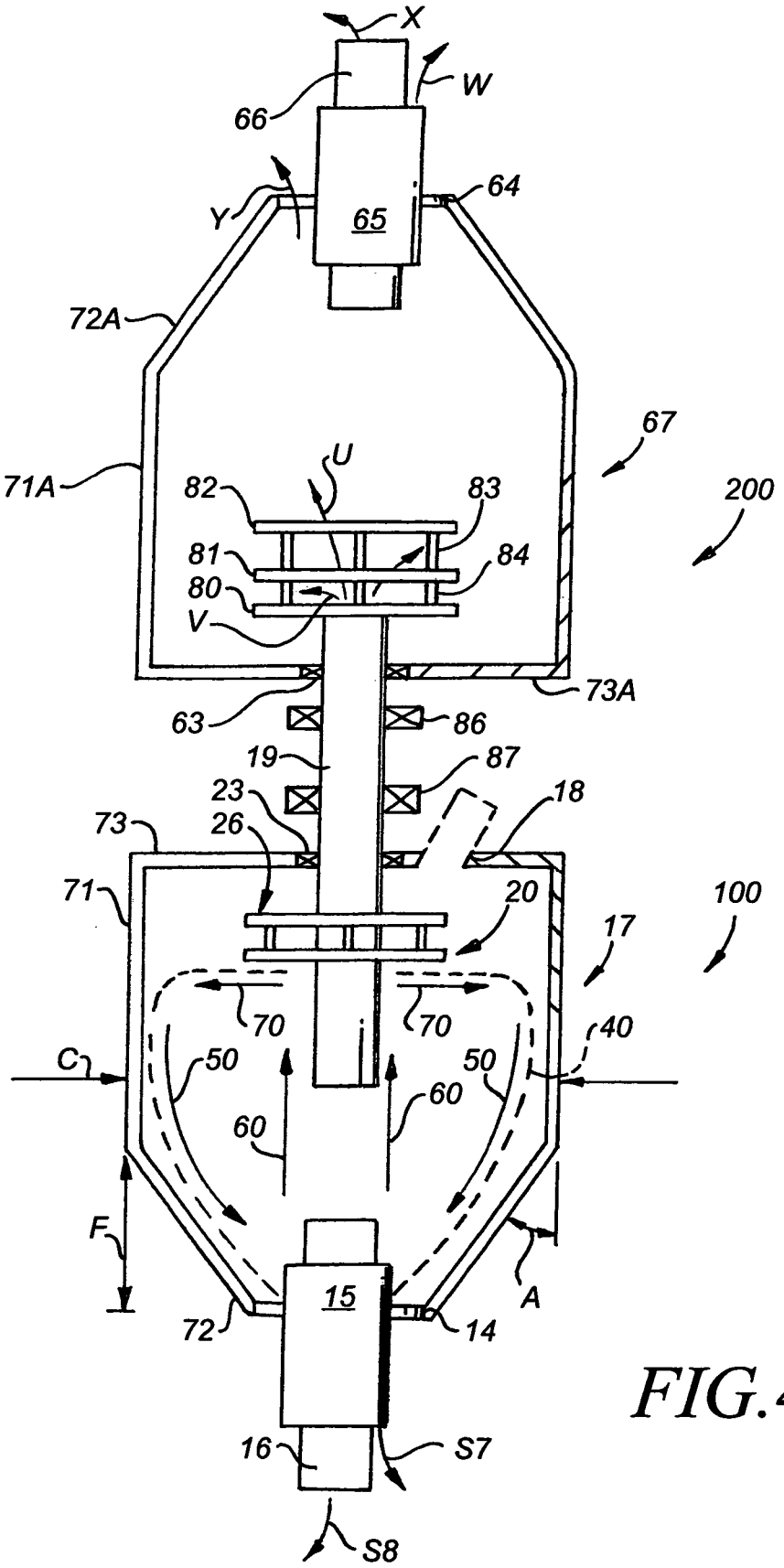

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a drilling system generally indicated by reference character 10. The system includes a derrick assembly generally indicated by reference character 11 and including a derrick 12. Crown block 13 and traveling block 47 are mounted on derrick 12. Hoisting drum 44 reels cable 46 in and out to control the elevation of traveling block 47 and to control the elevation of the upper end of mud hose 29. Mud pump 35 draws drilling mud from mud pit 34 through conduit 41 and into hose 29. Mud pump motor 36 provides motive power to operate pump 35. Valve 37 in hose 29 is open and valve 38 ordinarily is closed when pump 35 is directing drilling mud into hose 29. Drilling mud can, if desired, be drawn from pit 34 through conduit 39 in the direction of arrow T to the particle separation apparatus that is illustrated in FIGS. 3 and 4 and that is located on site as a part of the drilling system of FIG. 1. After being treated by the apparatus in FIG. 3 or 4, the resulting water can, if desired, be directed back into mud pit 34, can be directed in the direction of arrow Q through conduit 40A and open valve 38 into hose 29, can be broadcast on the ground 45 around the drilling assembly, can be (if appropriate) provided as drinking water to livestock, can be injected into a deep water injection well, can be used as irrigation water, etc.

The particle separation apparatus of FIGS. 3 and 4 can, instead of being located on site, be located at a central site or other site. Drilling mud or other fluids produced during drilling or maintenance of petroleum or other wells can be transported to the central site to be processed by the apparatus of FIG. 3 and/or 4. An example of another fluid that can be processed with the apparatus of FIG. 3 and/or 4 is swabbing water. After a petroleum well has been drilled to a desired depth, the casing is installed, the lower end of the casing is sealed and a plurality of small openings are formed in the lower end of casing wall to permit oil or another petroleum composition to flow into the casing. Over time these openings tend to become plugged, either with particulate or by the formation of rust. When the openings are plugged, the lower end of the casing is cleaned by swabbing or by coil tube cleaning. Both of these cleaning procedures are well known. Some wells are cleaned frequently, two to three times a week or more. Swabbing involves using a cleaning tool that includes cups that each have the shape of a suction cup and that function to capture and carry particulate up the casing back to the top of the casing when the tool is withdrawn from the casing. The cleaning tool is inserted in the casing, lowered to the lower end of the casing, and, after a cleaning fluid comprising at least water and soap is directed into the lower end of the casing, is moved about in the lower of the casing to remove rust and other particulate from the inside of the casing and from the small openings formed through the lower end of the casing wall. The water that remains after this cleaning process or the coil tube cleaning process is completed is called swabbing water. While the composition of swabbing water can vary, swabbing water typically includes water, surfactants, acids, rust particles, clay, sand, and shale chips.

Rotary table 28 rotates hollow drill pipe 48 and drill bit 19A in conventional fashion to bore a hole 41 in the ground 45. Motor 57 provides motive power for table 28. Bit 19A produces cuttings 40 as it bores through ground 45.

Drilling mud from hose 29 flows under pressure down into the upper end of pipe 48, through pipe 48, out the lower end of pipe 48 into the lower end 54 of hole 41, upwardly between pipe 48 and the inner generally cylindrical side of hole 41, and out through the upper end 55 of hole 41 onto table 32. The portion of table 32 nearest pipe 48 includes a screen that permits slurry or fluid to travel downwardly through the screen in the direction of arrow R into mud pit 34. The larger particles 33 continue down table 32 onto ground 45 or to some other desired location or container.

The casing pipes 42, 43 ordinarily are installed after the hole in the ground 45 is fifty to five hundred feet deep. During the first fifty to five hundred feet, the ground can consist primarily of sand. The sand can pack and block the travel of drilling mud upwardly intermediate pipe 48 and the side of hole 41. One approach used to solve this problem is to mix bentonite clay with water to produce the drilling mud. The clay swells and facilitates the upward travel of drilling mud intermediate pipe 48 and the side of hole 41. The clay also functions to seal the sand so the drilling mud will travel upwardly and so that the loss of water into the ground surrounding hole 41 is minimized.

Drilling mud as used herein means a fluid consisting of water in combination with (1) drill cuttings or other material that enters the mud while the mud flows outwardly from pipe 48 and upwardly intermediate pipe 48 and the side of hole 41, (2) bentonite clay, and/or (3) other additives that facilitate the drilling process. Surfactants, floculants, diesel fuel, kerosene and other well known chemical compositions are additives that can be incorporated in the drilling mud to facilitate the drilling process.

Before drilling mud that exits upwardly through end 55 of hole 41 is processed with the particle separation apparatus of FIGS. 3 and 4, the mud ordinarily is permitted to pass over the screen in table 32 to remove large particles from the drilling mud that travels downwardly in the direction of arrow R in FIG. 1. One advantage of the particle separation apparatus of FIGS. 3 and 4 is that, if desired, the drilling mud can be directed directly into the particle separations apparatus without first removing the larger particles therefrom. It is preferred, however, to remove the larger drill cuttings and other particles before the drilling mud is processed with the apparatus of FIGS. 3 and 4.

The particle separation apparatus 100 of FIG. 3 includes a wall defining a particle separation chamber 17, and orifice 18 formed in chamber 17 for charging a selected quantity of liquid slurry material through orifice 18 in the direction indicated by arrow S1 into chamber 17 to impinge the upper surface 21 a disk assembly 25. Disk assembly 25 includes disk 20 and disk 26. Disk 20 includes lower circular surface 27 and is fixedly secured to hollow rotating shaft 19. Disk 26 is connected to disk 20 by a plurality of spaced apart pins 22. Shaft 19 passes through a concentric aperture 41 that is formed through the center of disk 26. Shaft 19 does not contact disk 26. Disks 26 and 20 rotate simultaneously with shaft 19 and, when apparatus 100 is used in conjunction with apparatus 200 (FIG. 4), with disks 80, 81, 82. Shaft 19 is journalled for rotation in bushing or seal unit 23. A driven belt or other means (not shown) is provided for rotating shaft 19 in the direction of arrow A in fixed chamber 17 (or in fixed chamber 67). When shaft 19 rotates disks 80 to 82 in chamber 67, a vacuum is generated in chamber 67 that tends to draw material into the lower end of hollow tubing 19 in the direction of arrow S5. Material drawn into tubing 19 in the direction of arrow S5 exits the upper end of tubing 19 in the manner indicated by arrow S50 in FIG. 3, and, when it is elected to utilized apparatus 100 in conjunction with apparatus 200, exits the upper end of tubing 19 in the manner indicated by arrows U and V in FIG. 4.

Drilling mud or any other desired fluid directed through orifice 18 in the direction of arrow S1 impinges upper surface 21 and lower surface 21A of disk 26 and also impinges the upper surface of disk 20 The drilling mud that impinges the upper surfaces of disks 20 and 26 is outwardly radially distributed by rotating disks 20 and 26 in the manner indicated by arrows S2 and S3. Drilling mud outwardly distributed in the direction of arrows S2 and S3 ordinarily strikes the cylindrical wall of chamber 17 and moves downwardly along a helical path of travel in the direction of arrow S4. As the drilling mud moves downwardly in the direction of arrow S4, the mud follows a helical path that moves through open toroidal-shaped particle circulation space 40 and circumscribes the longitudinal axis 50 that defines the vertically oriented centerline of rotating tubing 19 and stationary tubing 16. Toroidal-shaped space 40 lies intermediate disk assembly 25 and the particle outlet comprised of hollow concentric opening 14 and spaced apart tubes 15, 16. Space 40 (FIG. 4) is circumscribed by a portion of the cylindrical wall 71 of chamber 17. In the practice of the invention, it is preferred that at least the peripheral areas of space 40 be open and unobstructed so that drilling mud distributed by disk assembly 25 has free primary helical paths of travel along which to move as the material descends downwardly from the disk assembly 25 in an ever tightening spiral toward the particle outlet comprised of opening 14, and tubes 15, 16. Similarly, the toroidal-shaped space 40 must permit drilling mud to move along unobstructed primary helical paths of travel from disk assembly 25 in the direction of arrows S4 and S5 into the lower end of tubing 19.

A secondary recirculation path is illustrated in FIG. 4 by arrows 50, 60, 70. Drilling mud particles (liquid slurry) in the secondary helical path move downwardly in the direction of arrow 50 in a converging helical path which spirals around a vertical axis the is coincident with the vertically oriented center lines of tubing 19 and tubing 16. Once the particles (liquid slurry) reach a position proximate tubes 15 and 16, the particles begin to move upwardly in the direction of arrow 60 in a helical path around said vertical axis. Once the particles reach a position proximate rotating disk 20, the surface 27 and/or the boundary layer on surface 27 imparts energy to the particles and causes them to move outwardly in the direction indicated by arrows 70. After the input of drilling mud through orifice 18 is discontinues, a portion of the drilling mud continues to move along a secondary recirculation helical path like the path illustrated in FIG. 4, and the chamber 17 does not completely purge itself of drilling mud.

In FIGS. 3 and 4, tubes 14, 15, 16 extend directly into space 40, which facilitates the travel of slurry material from disk assembly 25 through space 40 directly into opening 14 and tubes 15 and 16 in the manner indicated by arrows S6, S7, S8, respectively. As used herein, the term "greater fraction" shall indicate a quantity or fraction of liquid slurry that contains a plurality of particles that are either of a greater size or greater specific gravity than a plurality of particles which are found in another quantity of liquid slurry which comprises a "lesser fraction". Consequently, a greater fraction of slurry will usually weigh more than a lesser fraction of slurry. The material flowing into opening 14 intermediate the walls of opening 14 and tube 15 is a greater fraction of the liquid slurry than the material flowing through tube 15 intermediate the wall of tube 15 and the wall of tube 16. The material flowing intermediate the walls of tubes 15 and 16 is a greater fraction of the liquid slurry than the material flowing through tube 16 in the direction of arrow S8. Ordinarily, the material flowing through tube 19 in the direction of arrow S5 is a lesser fraction of the slurry than is the material flowing through tube 16 in the direction of arrow S8. When the drilling mud or other material processed by apparatus 100, 200 contains a gas, the gas can, if desired, be removed through tube 19 along with little or no liquid or particulate. Or, the drilling mud flowing through tube 19 in the direction of arrow S5 can consist primarily of water with a substantial portion of the clay and other particulate having been removed through opening 14 and tubes 15 and 16.

The cross-sectional inner hollow area of orifice 18 can vary as desired, as can the cross-sectional inner hollow areas of opening 14 and tubes 15, 16, 19.

Apparatus 100, 200 need not be in the vertical orientation illustrated in FIG. 4. Apparatus 100, 200 can be horizontally oriented or can be canted in any desired orientation.

Toroidal-shaped space 40 can be conically shaped, donut shaped, or any other desired shape that permits drilling mud or another material distributed by disk assembly 25 to follow an unobstructed helical path of travel as the slurry moves downwardly toward opening 14 and tubes 15 and 16. Hollow tube(s) 51 can be concentrically positioned in and spaced apart from tubing 19. The length of tube 51 is approximately equal to the length of tube 19 in FIG. 3. When tube 51 is inserted in tubing 19, tube 51 can be utilized to remove particulate which is finer than particulate passing intermediate the inner surface of tube 19 and tube 15.

Apparatus 100 includes circular panel shaped top 73 and lower conical side 72.

In FIG. 4, apparatus 200 is, as can be seen, generally equivalent in shape and dimension to apparatus 100, although the shape and dimension of apparatus 200 with respect to apparatus 100 can vary as desired. Apparatus 200 includes circular panel shaped top 73A, cylindrical side or wall 71A, and conical portion 72A. Opening 64 and tubes 65 and 66 are provided at the top of apparatus 200. The upper end of hollow tubing 19 is fixedly secured to circular disk 80. A circular opening (not visible) is formed through disk 81 in the same manner that circular opening 41 is formed through disk 26. A central opening can, if desired, also be formed through disk 82. But disk 82 presently preferably is solid so that at least some of the material exiting the upper end of tubing 19 flow into disk 82 and disk 82 functions to impart rotational energy to the material and to outwardly radially disperse the material.

A plurality of pins 84 secure disk 81 to disk 80 in the same manner that pins 22 secure disk 20 to disk 26. A plurality of pins 83 secure disk 82 to disk 81 in the same manner that pins 22 secure disk 20 to disk 26. The functioning of disks 80 to 82 and the flow patterns of material in apparatus 200 is generally equivalent to that of disks 20 and 26 and to the flow patterns in apparatus 100 except that fractions of material do not flow into tubing 19.

A particular advantage of the stacked apparatus 100–200 of FIG. 4 is that it facilitates the throughput of larger quantities of drilling mud and also facilitates the separation of various sizes of particulate or of liquids having a different specific gravity than that of water. If the difference in specific gravity between two materials is at least 0.05, then the apparatus of FIGS. 3 and 4 typically can be used to separate the two materials.

Another advantage of the stacked apparatus of FIG. 4 is that it can remove a variety of materials from water in a single pass through the apparatus, facilitating a rapid throughput of material. Typically about at least one hundred to two-hundred and fifty gallons per minute of drilling mud can be processed by the apparatus of FIG. 4. If desired, apparatus 100 can be utilized alone, and not in conjunction with apparatus 200. However, the stacked apparatus 100–200 is compact, provides advantages in rapidly and efficiently separating from water a plurality of fractions containing materials of various size and specific gravity, and provides the advantage that the vacuum drawing material into tubing 19 in the direction of arrow S5 is generated by the apparatus 200 that also separates into additional fractions the material drawn into tubing 19.

One factor contributing to the efficiency of stacked apparatus 100, 200 is that material entering tubing 19 is rotating, continues to rotate while it travels through tubing 19 to apparatus 200, and is rotating when it exits the upper end of tubing 19 in the directions indicated by arrow U and V.

A further factor contributing to the increased efficiency of stacked apparatus 100, 200 is that disks 20, 26, 80–82 each rotate in the same direction and each disk functions to impart energy to material in the stacked apparatus 100, 200.

Consequently, stacked apparatus 100, 200 is preferred over side-by-side units 100 and over individual units 100. Stacked apparatus 100, 200 is one important aspect of the invention.

While the shape and dimension of apparatus 100, 200 can, as noted, vary as desired, the following dimensions are presently preferred. The angle of cant A of walls 72 and 72A is preferably in the range of sixteen degrees to sixty-nine degrees. The diameter C of cylindrical walls 71, 71A is preferably from three and one-half inches to twenty-four inches. The height B of cylindrical walls 71, 71A is preferably in the range of four inches to thirty-six inches. The inside diameter D of openings 14, 64 is preferably in the range of four inches to three-eighths of an inch. The inside diameter of tube 15 is preferably in the range of three and one-half inches to one-half of an inch.

The height F of conical sides 72, 72A is preferably in the range of four inches to thirty six-inches. In particular (when C is twenty-four inches), when angle A is forty-five degrees, the height F is in the range of ten to fourteen inches, preferably twelve inches. When angle A is sixty-nine degrees, the height F is in the range of four inches to eight-inches, preferably six inches. When angle A is sixteen degrees, the height F is in the range of thirty inches to forty inches, preferably thirty-six inches. As the size of angle A increases, the height F decreases. The ratio of angle A to the height F is in the range of 2:1 to 12:1. This is an important feature of the invention in optimizing the separation of clay and various additives from water.

The inside diameter G of tube 19 is preferably in the range of four inches to one-half of an inch.

The height B of cylindrical walls 71, 71A is preferably less than about four times the diameter C of walls 71, 71A. This is an important feature of the invention.

Disks 20, 26, 80 to 82 typically rotate at speeds in the range of 500 to about 10,000 RPM, although speeds less than about 3000 RPM are presently preferred because greater speeds increase the rate at which seal 23 systems break down during rotation of tubing 19. The rotational speed of disks 20, 26, 80 to 82 can vary as desired.

The flow rate of material from apparatus 100 up through tubing 19, as well as the particle size distribution in fractions exiting opening 14 and tubes 15 and 16, can be controlled by varying the shape and dimension or any operational parameters of apparatus 100 in any desired manner; however, the following criteria are presently preferred.

First, the inner diameter of tubing 19 is important. If, for example, the material fed into apparatus 100 contains particles that have a width of one and a half inches or less and the inner diameter of tubing 19 is three inches, then most of the material fed into apparatus 100 will travel up into tubing 19. If the width of some of the particles is greater than one and a half inch, then a tubing 19 with an inner diameter of three inches begins to restrict movement of material into tubing 19. Therefore, the inner diameter of tubing 19 can be sized to restrict the flow of material into tubing 19.

Second, the flow rate of material into apparatus via orifice 18 affects the rate of flow of material into tubing 19. If, for example, material flows through orifice 18 into apparatus 100 at a flow rate of 200 gallons/minute to 250 gal/min, the amount of material that will flow into tubing 19 often will only be 75 gal/min to 100 gal/min.

Third, the diameter C of cylindrical walls 71, 71A affects the rate of flow of material into tubing 19.

Fourth, the inner diameter of opening 14 and tubing tubes 15 and 16 affects the rate of flow of material into tubing 19. The inner diameters can, for example, be sized such that a certain size particle can not enter tubing 19 or tubes 15 and 16.

Fifth, the angle A affects the flow rate of material into tubing 19. If angle A and the diameter C are selected and the size of opening 14 is known, then length F is "set" or can be calculated.

Sixth, the position inside apparatus of tubes 15, 16, 51. Tubes 15, 16 can be moved upwardly or downwardly to position the upper ends of each tube nearer or further from the lower end of tubing 19 in FIG. 4. Tube 51 can be moved upwardly or downwardly inside tubing 19 to position the lower end of tube 51 closer to or further from the lower end of tubing 19 in FIG. 4.

Seventh, the rotational speed of the disks 20 and 26.

The seven factors noted above can also be used to vary the composition of fractions exiting apparatus 200. The seven factors when applied to apparatus 100 determine the composition of material that travels up through tubing 19 into apparatus 200. The seven factors when applied to the configuration of apparatus 200 determine the composition of fractions exiting apparatus in the directions indicated by arrows Y, W, X.

By way of example, and not limitation, in one configuration of the apparatus 100 angle A is fifteen degrees, cylindrical wall 71 has a height B (FIG. 3) of thirty inches, wall 71 has a diameter of twenty-four inches, disks 20 and 26 have a diameter of eighteen inches, and tubing 19 has an inner diameter of three and three-quarters inches.

By way of example, and not limitation, the apparatus of FIG. 4 can produce the following fractions when the apparatus has been used to process an inverted drilling mud that includes benzene, toluene, and kerosene, that includes particles that have a size in the range of from sub-micron to about one-half inch in width, and that is about 20–30% by weight solids and about 70% to 80% by weight water. Apparatus 100, 200 can process a material that is 50% by weight solids and 50% by weight water, but it is preferred that the material consist of 20–30% by weight solids with the remainder being water or some other liquid.

1. The fraction passing outwardly through opening 14 of apparatus 100 is at least 90% by weight solids and less than 10% by weight water. The solids consist primarily of shale chips and the largest sand particles. This material is, as will be discussed below, dry.
2. The fraction passing outwardly through tube 15 in the direction indicated by arrow S7 consists of 85% to 88% by weight solids, with the remainder being water. The solids consist primarily of fine shale chips, fine sand, and the largest clay particles (five to ten microns). This material likely is dry unless it is comprised largely of sand.
3. The fraction passing outwardly through tube 16 in the direction indicated by arrow S8 consists of about 85% by weight solids, with the remainder being water. The solids consist primarily of bentonite clay particles. This material likely also is dry.
4. The fraction passing outwardly through opening 64 in the direction indicated by arrow Y consists of about 95% by weight water and less than about 5% by weight solids. The solids consist primarily of bentonite clay and humus particles.
5. The fraction passing outwardly through tubing 65 in the direction indicated by arrow W is the clearest water produced and includes 98% to 99% by weight water, with the remainder consisting of petroleum hydrocarbons and solids.
6. The fraction passing outwardly through tubing 66 in the direction of indicated by arrow X consists of about 94 to 95% by weight petroleum hydrocarbons (kerozene, benzene, toluene), of about 5% to 6% by weight water, and of a small amount of particulate, typically less than about 0.01%.

One important advantage of the invention is that apparatus 100 produces material that is "dry". As used herein, dry means the material will pass the paint filter test. The paint filter test is well known and will not be explained in detail herein. However, for purposes of providing an overview, during the paint filter test, a quantity of material is placed in a cone or other shaped container comprised of paint filter paper. The quantity of material typically is generally about equivalent to an ice cream scoop full of the material. If within three to five minutes, water does not pass through the filter under the force of gravity to the underside of the filter and drop to the ground from the underside of the filter, the material is considered dry. Water beads can form on the underside of the filter, but if the drops do not fall and separate from the filter, the material in the filter is considered dry. If a material is dry, it only costs about $15.00 per ton to put in a landfill. If a material is wet, it costs about $200.00 per ton to put in a landfill. As described in the above example, the fraction exiting opening 14, the fraction exiting tubing 15 in the direction of arrow S7, and the fraction exiting tubing 16 in the direction of arrow S8 likely are all dry, which greatly reduces the cost of disposing of these materials in a landfill.

Although the shape and dimension of apparatus 200 can be equivalent to that of apparatus 100, in most cases the shape and dimension of apparatus 200 is different than that of apparatus 100. Further, apparatus 200 is usually smaller than apparatus 100. For example, If the diameter of disks 20 and 26 is nineteen and one-half inches, then the diameter of disks 80 to 82 is thirteen and one-half inches. If the diameter of cylindrical wall 71 is twenty inches, then the diameter of cylindrical wall 71A may be ten inches. The size of each disk 80 to 82 (or 20, 26) can be identical, as shown in FIG. 4, or the size of each disk 80 to 82 (or 20, 26) can vary from that of the other disks 80 to 82 (20, 26).

One advantage of the petroleum drilling system of the invention is that the apparatus of FIGS. 3 and 4 can be quickly installed at a drilling site with minimal expense.

Another advantage of the petroleum drilling system of the invention is that it can process drilling mud and produce water that has a large portion of particulate and other chemicals removed, that is environmentally safe, and that can in many cases to disposed of by broadcasting the water on the land around the drilling site, that can be inserted in deep water injection wells, or than can be used to water livestock. The drilling system of the invention can process drilling mud before or after the mud has been injected into pipe 48.

A further advantage of the petroleum drilling system of the invention is that it can completely eliminate the need to truck large quantities of drilling mud away from a drilling site.

Still another advantage of the petroleum drilling system of the invention is that it eliminates the need to construct and man large settling tanks in which water is stored to permit particulate to separate out under gravity.

Still a further advantage of the petroleum drilling system of the invention is that it can rapidly process large quantities of drilling mud.

Yet another advantage of the petroleum drilling system of the invention is that it permits drilling mud and/or water readily to be reused or recycled during the drilling process.

Yet a further advantage of the petroleum drilling system of the invention is that it drastically reduces the amount of water necessary to drill a well. Drilling a well typically consumes from about 80,000 gallons to 250,000 gallons of water. Drilling systems constructed in accordance with the invention will typically consume only about 25,000 to 30,000 gallons of water. This is possible because of the rapid throughput of the apparatus of FIG. 4 and because of the ability of the apparatus of FIG. 4 to remove a large proportion of the clay or additives in the water used in the drilling mud.

Yet still another advantage of the invention is that a large portion of the water used to drill a well can be reclaimed. About 20,000 gallons of the 25,000 to 30,000 gallons required normally can be successfully reclaimed.

Yet still a further advantage of the invention is that, in addition to removing the necessity to truck toxic drilling mud away from a drilling site, the invention greatly reduces the cost of trucking water to the drilling site.

Another advantage of the invention is that the separation achieved by apparatus 100, 200 is accomplished mechanically and does not normally require the use of floculants or other chemical additives. In fact, in many cases the pH of water produced by apparatus 100, 200 will approach neutral (pH of 7).

The invention solves environmental, cost, and water shortage problems that have long been associated with drilling petroleum wells.

Figure 2:
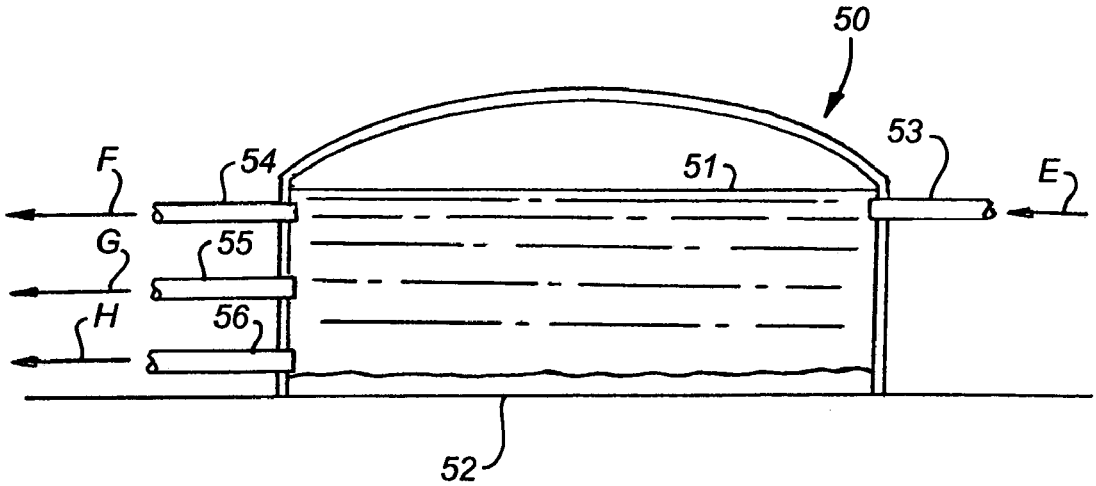
FIG. 2 is a section view of a petroleum settling tank utilized in one embodiment of the invention.

FIG. 2 illustrates a petroleum storage tank 50. Petroleum 51 is directed into the tank 50 in the direction of arrow E through conduit 53. Petroleum 51 can be removed from the tank 50 in the directions indicated by arrows F, G, H through one or more conduits 54 to 56, respectively. The petroleum is stored in tank 50 to permit clays, silicas, and brine water to settle to the bottom of tank 50 to form a layer of sludge. It can require from one-half a month to six months for these materials to settle out of the petroleum. It typically will take at least sixty days for the clays, silicas, etc. to settle out of the petroleum. In another embodiment of the invention, petroleum 51 is directed through the apparatus of FIG. 3 or, preferably, of FIG. 4 to rapidly remove clays, silicas, etc. from the petroleum and to obviate having to store the petroleum 51 in tank 50 for the purpose of settling out the clays, silicas, etc. by gravity. In a further embodiment of the invention, the sludge 52 at the bottom of a tank 50 is directed through the apparatus of FIG. 3 or FIG. 4 to separate petroleum hydrocarbons, clay, and other materials from the sludge. Disposing of sludge 52 presently can cost $500.00 per cubic meter. Processing the sludge 52 with the particle separation apparatus of FIG. 3 or FIG. 4 can significantly reduce the cost of disposing of sludge 52.

Another application of the particle separation apparatus of FIGS. 3 and 4 is to feed into the apparatus sand particles that are coated with oil and other materials and to use the apparatus to separate the oil from the sand and, possible, to separate the oil from any of the other materials.

We claim:

1. A method for drilling for petroleum, comprising the steps of (a) erecting a derrick assembly on the ground;

(b) mounting a drill on said derrick assembly, said drill including a hollow drill pipe having an upper end and a lower end and a drill bit attached to the lower end;

(c) mounting a rotary assembly at said derrick assembly to provide motive power to rotate said drill bit in the ground to produce drill bit cuttings;

(d) mounting a drilling mud circulation system at said derrick assembly to direct primary drilling mud into said upper end of said drill pipe, down through said drill pipe, out the lower end of said drill pipe, and up through a hole in the ground to produce auxiliary drilling mud containing drill bit cuttings;

(e) providing a source of primary drilling mud for said circulation system, said mud including water and clay and substantially free of drill bit cuttings;

(f) providing a first particle separation apparatus including (i) at least one stationary wall defining a stationary separation chamber, (ii) a feed inlet orifice formed in said chamber, (iii) at least one rotary distributor in said chamber including a rotating distribution disk including an upper surface, (iv) a drive system for rotatably driving said rotary distributor to rotate said disk and said upper surface at a speed in the range of 500 RPM to 10,000 RPM, (v) at least first and second outlets formed in said wall, (vi) an open particle circulation space intermediate said disk system and said outlet and circumscribed by a portion of said wall, said outlet opening into said particle circulation space, (vii) a charging system for charging auxiliary drilling mud containing drill bit cuttings through said orifice into said separation chamber toward said rotary distributor such that said auxiliary drilling mud, at least in part, impinges said upper surface, said rotary distributor providing the motive power to move at least a portion of the auxiliary drilling mud outwardly over said upper surface and into said chamber away from said rotary distributor, a first portion of said auxiliary drilling mud over said upper surface and into said chamber in a primary continuous helical path of travel away from said rotary distributor and said orifice through said circulation space toward and into said outlet, a second portion of the auxiliary drilling mud in a secondary recirculating helical path of travel away from said rotary distributor and said orifice through said circulation space toward said outlet and away from said outlet back toward said rotary distributor:

(g) rotating said drill into the ground with said rotary assembly to form said hole in the ground and produce drill bit cuttings in said hole, said hole having a top and a side;

(h) circulating primary drilling mud with said mud circulation system along a path down into said upper end of said drill pipe, through said drill pipe, out said lower end of said drill pipe, up through said hole intermediate said drill pipe and said side of said hole, and out through said top of said hole, to produce said auxiliary drilling mud containing drill bit cuttings;

(i) operating said a drive system to rotate said upper surface at a speed in the range of 500 RPM to 10,000 RPM;

(j) transporting to said charging system said auxiliary drilling mud, said charging system directing said auxiliary drilling mud through said inlet orifice into said stationary separation chamber toward said rotary distributor such that the material directed through said inlet orifice is at least fifty percent by weight liquid and such that said auxiliary drilling mud, at least in part, impinges said rotating upper surface such that (i) first dry material including clay passes outwardly from within said stationary wall through said first outlet, and (ii) second dry material passes outwardly from within said stationary wall through said second outlet;

(k) transporting at least said first dry material to a landfill; and, (l) depositing said first dry material in the landfill.

2. The method of claim 1 wherein said circulation space is toroidal-shaped.

3. The method of claim 2 wherein said circulation space has a conical base with a side at an angle (A) from the vertical and with a height (F) wherein the ratio of said angle (A) to said height (F) is in the range of 2:1 to 12:1.

4. The method of claim 3 wherein said circulation space has a cylindrical portion with a side having a height (B) that is less than about four times the diameter (C) of said cylindrical portion.

5. The method of claim 4 wherein said particle separation apparatus is shaped and dimension to permit one hundred to two-hundred and fifty gallons per minute of said auxiliary drilling mud to be processed by said particle separation apparatus.

6. A method for drilling for petroleum, comprising the steps of (a) erecting a derrick assembly on the ground;

(b) mounting a drill on said derrick assembly, said drill including a hollow drill pipe having an upper end and a lower end and a drill bit attached to the lower end;

(c) mounting a rotary assembly at said derrick assembly to provide motive power to rotate said drill bit in the ground to produce drill bit cuttings;

(d) mounting a drilling mud circulation system at said derrick assembly to direct primary drilling mud into said upper end of said drill pipe, down through said drill pipe, out the lower end of said drill pipe, and up through a hole in the ground to produce auxiliary drilling mud containing drill bit cuttings;

(e) providing a source of said primary drilling mud for said circulation system, said mud including water and clay and substantially free of drill bit cuttings;

(f) providing a particle separation apparatus including (i) a first stationary wall defining a first stationary separation chamber, (ii) a feed inlet orifice formed in said chamber, (iii) at least one rotary distributor including a first end of a hollow rotating shaft, said first end positioned in said chamber, said rotating shaft also including a second end located outside said chamber, and a first distribution disk mounted on said first end to rotate in said chamber simultaneously with said shaft and including an upper surface, (iv) at least a first outlet formed in said wall, (vi) an open first particle circulation space intermediate said disk and said outlet and circumscribed by a portion of said wall, said outlet opening into said particle circulation space, (vii) a charging system for charging auxiliary drilling mud through said orifice into said first separation chamber toward said disk such that said auxiliary drilling mud, at least in part, impinges said upper surface, said rotating distribution disk providing the motive power to move at least a portion of said auxiliary drilling mud outwardly over said upper surface and into said chamber away from said disc, a first portion of the auxiliary drilling mud over said upper surface and into said chamber in a primary continuous helical path of travel away from said rotary disc and said orifice through said circulation space toward and into and through said outlet as a dry fraction including clay, a second portion of the auxiliary drilling mud in a secondary recirculating helical path of travel away from said rotary distributor and said orifice through said circulation space toward said outlet and away from said outlet back toward said rotary distributor and into said first end of and rotatably through said hollow rotary shaft, (viii) a second stationary wall defining a second stationary separation chamber, (ix) at least a second rotary distributor including said second end of said hollow rotating shaft positioned in said second chamber, and a second distribution disk mounted on said second end to rotate in said second chamber simultaneously with said second end and including an upper surface, (x) at least a second outlet formed in said second wall, (xi) an open second particle circulation space intermediate said second disk and said second outlet and circumscribed by a portion of said second wall, said second end of said hollow rotary shaft opening into said second particle circulation space such that said second portion of said auxiliary drilling mud rotatably exits from said second end, travels toward said second disk such that said second portion, at least in part, impinges said upper surface of said second disk, said second rotating disk providing the motive power to move at least a portion of the auxiliary drilling mud outwardly over said upper surface of said second disk and into said second chamber away from said second disk, a primary portion of said second portion over said upper surface of said second disk and into said second chamber in a primary continuous helical path of travel away from said second disk away from said second end through said second circulation space toward and into and through said second outlet as a liquid portion including water, a secondary portion of said second portion in a secondary recirculating helical path of travel away from said second disk and said second end through said second circulation space toward said second outlet and then away from said second outlet back toward said second end of said rotary shaft, (xii) a drive system to rotatably turn said hollow rotary shaft at a speed in the range of 500 RPM to 10,000 RPM, and (xiii) a return system to direct said liquid portion into said source of said primary drilling mud before said primary drilling mud is directed into said upper end of said drill pipe;

(h) rotating said drill into the ground with said rotary assembly to form said hole in the ground and produce drill bit cuttings in said hole, said hole having a top and a side;

(i) operating said drilling mud circulation system and said return system to direct said liquid portion into said primary drill mud before said primary drilling mud is directed into said upper end of said drill pipe, and circulate drilling mud with said mud circulation system along a path down into said upper end of said drill pipe, through said drill pipe, out said lower end of said drill pipe, up through said hole intermediate said drill pipe and said side of said hole, and out through said top of said hole, to produce said auxiliary drilling mud containing drill bit cuttings;

(j) operating said drive system to rotate said upper surface of said first distribution disk and of said second distribution disk at a speed in the range of 500 RPM to 10,000 RPM;

(k) transporting to said charging system said auxiliary drilling mud, said charging system directing said auxiliary drilling mud through said inlet orifice into said first stationary separation chamber toward said first distribution disk such that the material directed through said inlet orifice is at least fifty percent by weight liquid and such that said auxiliary drilling mud, at least in part, impinges said rotating upper surface of said first distribution disk such that (i) first dry material including clay passes outwardly from within said stationary wall into and through said first outlet, (ii) second dry material passes outwardly from within said stationary wall into and through said second outlet, (iii) said second portion rotatably travels into said first end of said hollow rotary shaft, through said hollow shaft, and out said second end of said hollow rotary shaft into said second separation chamber, and (iv) said secondary portion of said second portion travels into and through said second outlet as a liquid portion including water;

(l) operating said return system to direct said liquid portion to said source of said primary drilling mud before said primary drilling mud is directed into said upper end of said drill pipe;

(m) transporting at least said first dry material to a landfill; and, (n) depositing said first dry material in the landfill.

7. The method of claim 6 wherein said liquid portion is substantially all water.

8. The method of claim 6 wherein said circulation spaces are toroidal-shaped.

9. The method of claim 8 wherein said circulation spaces each have a conical base with a side at an angle (A) from the vertical and with a height (F) wherein the ratio of said angle (A) to said height (F) is in the range of 2:1 to 12:1.

10. The method of claim 9 wherein said circulation spaces each have a cylindrical portion with a side having a height (B) that is less than about four times the diameter (C) of said cylindrical portion.

11. The method of claim 10 wherein said particle separation apparatus is shaped and dimensioned to permit one hundred to two-hundred and fifty gallons per minute of said auxiliary drilling mud to be processed by said particle separation apparatus.

12. The method of claim 6 wherein said liquid portion is substantially all water.

13. A method for drilling for petroleum, comprising the steps of (a) erecting a derrick assembly on the ground;

(b) mounting a drill on said derrick assembly, said drill including a hollow drill pipe having an upper end and a lower end and a drill bit attached to the lower end;

(c) mounting a rotary assembly at said derrick assembly to provide motive power to rotate said drill bit in the ground to produce drill bit cuttings;

(d) mounting a drilling mud circulation system at said derrick assembly to direct primary drilling mud into said upper end of said drill pipe, down through said drill pipe, out the lower end of said drill pipe, and up through a hole in the ground to produce auxiliary drilling mud containing drill bit cuttings;

(e) providing a source of said primary drilling mud for said circulation system, said mud substantially free of drill bit cuttings and including water, clay and at least one petroleum hydrocarbon;

(f) providing a particle separation apparatus including (i) a first stationary wall defining a first stationary separation chamber, (ii) a feed inlet orifice formed in said chamber, (iii) at least one rotary distributor including a first end of a hollow rotating shaft, said first end positioned in said chamber, said rotating shaft also including a second end located outside said chamber, and a first distribution disk mounted on said first end to rotate in said chamber simultaneously with said shaft and including an upper surface, (iv) at least a first outlet formed in said wall, (vi) an open first particle circulation space intermediate said disk and said outlet and circumscribed by a portion of said wall, said outlet opening into said particle circulation space, (vii) a charging system for charging auxiliary drilling mud through said orifice into said first separation chamber toward said disk such that said auxiliary drilling mud, at least in part, impinges said upper surface, said rotating distribution disk providing the motive power to move at least a portion of said auxiliary drilling mud outwardly over said upper surface and into said chamber away from said disc, a first portion of the auxiliary drilling mud over said upper surface and into said chamber in a primary continuous helical path of travel away from said rotary disc and said orifice through said circulation space toward and into and through said outlet as a dry fraction including clay, a second portion of the auxiliary drilling mud in a secondary recirculating helical path of travel away from said rotary distributor and said orifice through said circulation space toward said outlet and away from said outlet back toward said rotary distributor and into said first end of and rotatably through said hollow rotary shaft, (viii) a second stationary wall defining a second stationary separation chamber, (ix) at least a second rotary distributor including said second end of said hollow rotating shaft positioned in said second chamber, and a second distribution disk mounted on said second end to rotate in said second chamber simultaneously with said second end and including an upper surface, (x) at least a second and third outlets formed in said second wall, (xi) an open second particle circulation space intermediate said second disk and said second outlet and circumscribed by a portion of said second wall, said second end of said hollow rotary shaft opening into said second particle circulation space such that said second portion of said auxiliary drilling mud rotatably exits from said second end, travels toward said second disk such that said second portion, at least in part, impinges said upper surface of said second disk, said second rotating disk providing the motive power to move at least a portion of the auxiliary drilling mud outwardly over said upper surface of said second disk and into said second chamber away from said second disk, a primary portion of said second portion into said second chamber in a primary helical path of travel away from said second disk and away from said second end through said second circulation space toward and into and through said second outlet as a first liquid portion including a portion of said water, a secondary portion of said second portion in a secondary recirculating helical path of travel away from said second disk and said second end through said second circulation space toward said second outlet and then away from said second outlet back toward said second end of said rotary shaft, a tertiary portion of said second portion into said second chamber in a primary helical path of travel away from said second disk and away from said second end through said second circulation space toward and into and through said third outlet as a second liquid portion including a portion of said petroleum hydrocarbon, (xii) a drive system to rotatably turn said hollow rotary shaft at a speed in the range of 500 RPM to 10,000 RPM, and (xii) a return system to direct said liquid portion into said source of said primary drilling mud before said primary drilling mud is directed into said upper end of said drill pipe;

(h) rotating said drill into the ground with said rotary assembly to form said hole in the ground and produce drill bit cuttings in said hole, said hole having a top and a side;

(i) operating said drilling mud circulation system and said return system to direct said liquid portion into said primary drill mud before said primary drilling mud is directed into said upper end of said drill pipe, and circulate drilling mud with said mud circulation system along a path down into said upper end of said drill pipe, through said drill pipe, out said lower end of said drill pipe, up through said hole intermediate said drill pipe and said side of said hole, and out through said top of said hole, to produce said auxiliary drilling mud containing drill bit cuttings;

(j) operating said drive system to rotate said upper surface of said first distribution disk and of said second distribution disk at a speed in the range of 500 RPM to 10,000 RPM;

(k) transporting to said charging system said auxiliary drilling mud, said charging system directing said auxiliary drilling mud through said inlet orifice into said first stationary separation chamber toward said first distribution disk such that the material directed through said inlet orifice is it least fifty percent by weight liquid and such that said auxiliary drilling mud, at least in part, impinges said rotating upper surface of said first distribution disk such that (i) first dry material including clay passes outwardly from within said stationary wall into and through said first outlet, (ii) second dry material passes outwardly from within said stationary wall into and through said second outlet, (iii) said second portion rotatably travels into said first end of said hollow rotary shaft, through said hollow shaft, and out said second end of said hollow rotary shaft into said second separation chamber, (iv) said secondary portion of said second portion travels into and through said second outlet as a first liquid portion including water, and (v) said tertiary portion of said second portion travels into and through said third outlet as a second liquid portion including petroleum hydrocarbon;

(l) operating said return system to direct said first liquid portion to said source of said primary drilling mud before said primary drilling mud is directed into said upper end of said drill pipe;

(m) transporting at least said first dry material to a landfill; and, (n) depositing said first dry material in the landfill.

14. The method of claim 13 wherein said first liquid portion is substantially all water and said second liquid portion is substantially all petroleum hydrocarbon.

* * * * *